US009402495B2

(12) United States Patent
Laibe

(10) Patent No.: US 9,402,495 B2
(45) Date of Patent: Aug. 2, 2016

(54) ADJUSTABLE HANGER

(71) Applicant: Erik Laibe, Torrance, CA (US)

(72) Inventor: Erik Laibe, Torrance, CA (US)

( * ) Notice: Subject to any disclaimer, the term of this patent is extended or adjusted under 35 U.S.C. 154(b) by 518 days.

(21) Appl. No.: 13/920,441

(22) Filed: Jun. 18, 2013

(65) Prior Publication Data

US 2014/0367425 A1 Dec. 18, 2014

(51) Int. Cl.
*A41D 27/22* (2006.01)
*A47G 25/44* (2006.01)
*A47G 25/32* (2006.01)

(52) U.S. Cl.
CPC ..... *A47G 25/442* (2013.01); *A47G 25/32* (2013.01)

(58) Field of Classification Search
CPC ..... A47G 25/44–25/446
USPC ..... 223/89, 90, 94, DIG. 4
See application file for complete search history.

(56) References Cited

U.S. PATENT DOCUMENTS 4,717,053 A * 1/1988 Wang ..... A47G 25/4053 211/118
5,074,446 A 12/1991 Suddath
5,082,152 A * 1/1992 Chen ..... A47G 25/442 211/117
5,344,054 A * 9/1994 Nutter ..... A47G 25/442 223/89
5,456,391 A * 10/1995 Chang ..... A47G 25/443 223/89
5,511,701 A * 4/1996 Lam ..... A47G 25/443 223/85
5,577,644 A * 11/1996 Chen ..... A47G 25/005 223/85
5,664,710 A * 9/1997 Lam ..... A47G 25/443 223/85
5,901,888 A * 5/1999 Schneider ..... A47G 25/1442 223/88
6,062,445 A * 5/2000 Nakamoto ..... A47G 25/442 223/89
6,644,520 B2 * 11/2003 Lam ..... A47G 25/443 223/85
6,964,360 B2 11/2005 Tubman
7,201,298 B2 4/2007 Miura
8,256,650 B2 * 9/2012 Sokol ..... A47G 25/442 223/89
2002/0056735 A1 * 5/2002 Lam ..... A47G 25/443 223/94
2003/0132258 A1 * 7/2003 Viazanko ..... A47G 25/743 223/85
2004/0016779 A1 * 1/2004 Salem ..... A47G 25/442 223/94

* cited by examiner

*Primary Examiner* — Nathan Durham

(57) ABSTRACT

An adjustable hanger includes a hook member, a coupler, and two arms. Said coupler serves as the main frame of the adjustable hanger, wherein the two arms are releasably connected. The releasable connection allows for the arms to be adjusted. The arms may be extended and retracted such as to fit garments of varying sizes. The arms may be secured in place by a variety of mechanisms, including male/female connections between said arms and said coupler, as well as arm holders. Said arms also include shoulder portions of a wide nature such that garments may be placed upon said adjustable hanger such that said garments do not form creases or other aberrations.

2 Claims, 14 Drawing Sheets

ADJUSTABLE HANGER

TECHNICAL FIELD OF THE INVENTION

The present adjustable hanger relates in general to a hanger, and more specifically to a hanger whose arms may be extended and retracted to match a particular garment's size.

BACKGROUND OF THE INVENTION

A hanger is an excellent device for storing and maintaining a garment. It may be particularly useful for a jersey, a T-shirt, a long sleeved shirt, a sweater, a jacket, pants etcetera. Storing such garments on hangers helps to utilize closet space while saving dresser space. Using a hanger may also help to properly maintain a garment by helping to eliminate creases created by folding said garment and storing it in a dresser. Hanging a garment on a typical hanger, however, presents a host of issues.

Many people use a typical hanger generally comprised of tubular plastic or metal no more than a few millimeters thick, in the general shape of an isosceles triangle, and with a hook member near where the two equal sides of the isosceles triangle meet. Generally, such a hanger has a tendency to cause bumps and creases in clothing, making it look unnatural or improperly cared for, because it is relatively thin and provides very little support. Even if a shirt is perfectly placed upon such a hanger, gravity pulls downward while the hanger stubbornly resists, leaving a perceptible aberration on the shirt.

Various hangers have been developed to address these issues. Broad shouldered hangers, for example, provide much more support while eliminating the aberration problem. U.S. Pat. Nos. 7,201,298 and 6,964,360 are examples of such hangers. The problem with these types of hangers, however, is that they tend to be relatively expensive to manufacture, assemble, and ship. They may also be heavy. Other hanger forms such as U.S. Pat. No. 5,074,446 are generally formed into a given length and may only be efficiently used with garments of specific sizes. These captively designed hangers lack adjustability.

There is a need in the art for a hanger that provides the adequate support of a broad shouldered hanger, yet is slim, easy to manufacture, and adjustable. It is to these ends that the present adjustable hanger has been developed.

BRIEF SUMMARY OF THE INVENTION

To minimize the limitations in the prior art, and to minimize other limitations that will be apparent upon reading and understanding the present specification, the present adjustable hanger describes an adjustable hanger comprising a coupler having a first male coupler connector and a second male coupler connector, a hook member, a first arm comprising a first shoulder portion and a first female arm connector, a second arm comprising a second shoulder portion and a second female arm connector, and wherein said coupler is configured to receive said hook member, said first arm, and said second arm, and said hook member, said first arm, and said second arm are releasably connected to said coupler.

Said hook member is releasably connected to said coupler, said hook member comprising a male hook base connector, and said coupler comprising a female hook base connector. Said hook member is capable of rotating about an axis running perpendicularly from a planar surface through the center of said male hook base connector and said female hook base connector of said adjustable hanger in an upright position.

Said first female arm connector of said first arm comprises at least one first female tooth, and said second female arm connector of said second arm comprises at least one second female tooth. Said first male coupler connector comprises a first plurality of male teeth, and said second male coupler connector comprises a second plurality of male teeth.

Said coupler comprises one or more first arm holders configured such that said first arm is situated above said one or more first arm holders when said first arm is releasably attached to said coupler, and one or more second arm holders configured such that said second arm is situated above said one or more second arm holders when said second arm is releasably attached to said coupler.

Said first arm comprises a first rail on the lower portion of said first arm extending the length of said first arm, said first rail situated above said one or more first arm holders when said first arm is releasably connected to said coupler, and said second arm comprises a second rail on the lower portion of said second arm extending the length of said second arm, said second rail situated above said one or more second arm holders when said second arm is releasably connected to said coupler.

Said first arm comprises a first center portion extending the length of said first arm between said first rail and said first shoulder portion, said first center portion comprising one or more first openings extending the length of said first center portion, and said second arm further comprises a second center portion extending the length of said second arm between said second rail and said second shoulder portion, said second center portion comprising one or more second openings extending the length of said second center portion.

Said first rail comprises a first groove situated underneath said first rail and extending the length of said first rail, and said second rail comprises a second groove situated underneath said second rail and extending the length of said second rail.

Said one or more first arm holders comprises one or more first protrusions situated near the upper center portion of said one or more first arm holders, configured to guide and receive said first groove when said first arm is releasably connected to said coupler, and wherein said one or more second arm holders comprises one or more second protrusions situated near the upper center portion of said one or more second arm holders, configured to guide and receive said second groove when said second arm is releasably connected to said coupler.

It is an objective of the present adjustable hanger to be adjustable such that it may be adjusted to hold garments of different sizes.

Is another objective of the present adjustable hanger to provide adequate support such that garments do not become disfigured when hung.

It is yet another objective of the present adjustable hanger to be able to be easily manufactured at low costs.

These and other advantages and features of the present adjustable hanger are described herein with specificity so as to make the present adjustable hanger understandable to one of ordinary skill in the art.

BRIEF DESCRIPTION OF THE SEVERAL VIEWS OF THE DRAWINGS

Elements in the FIGS. have not necessarily been drawn to scale in order to enhance their clarity and improve understanding of these various elements and embodiments of the adjustable hanger. Furthermore, elements that are known to be common and well understood to those in the industry are not depicted in order to provide a clear view of the various embodiments of the adjustable hanger.

DETAILED DESCRIPTION OF THE INVENTION

In the following discussion that addresses a number of embodiments and applications of the present adjustable hanger, reference is made to the accompanying drawings that form a part thereof, where depictions are made, by way of illustration, of specific embodiments in which the adjustable hanger may be practiced. It is to be understood that other embodiments may be utilized and changes may be made without departing from the scope of the adjustable hanger.

Figure 1:
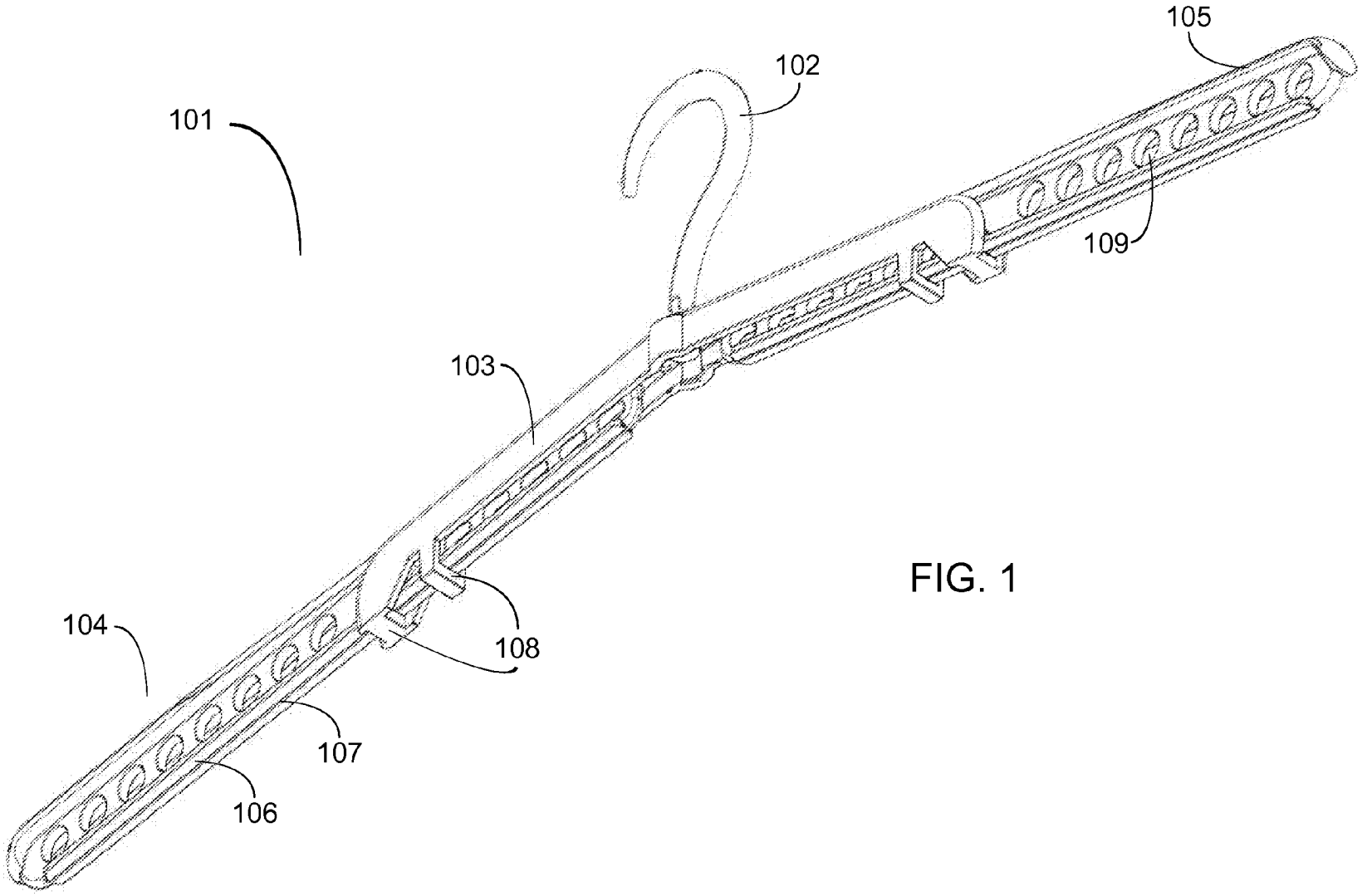
FIG. 1 is a three dimensional lower view of an adjustable hanger.

FIG. 1 is a three dimensional lower view of adjustable hanger 101. Adjustable hanger 101 may be generally comprised of hook 102, coupler 103, and two arms 104. Hook 102, coupler 103, and arms 104 may be separately manufactured, individually packaged, and releasably connected by an end user. However, this is not to limit the scope of adjustable hanger 101. In another embodiment, hook 102 may be releasably connected to coupler 103 in the manufacturing process while arms 104 may be releasably connected by an end user. In yet another embodiment, hook 102, coupler 103, and arms 104 may all be solidly connected during the manufacturing process, yet still allow for arms 104 to be adjustable. Each of these embodiments is within the spirit of adjustable hanger 101 and other similar variations are possible without departing from the scope of adjustable hanger 101.

The various components comprising adjustable hanger 101, and thus adjustable hanger 101 itself, may be comprised out of an array of raw materials. For example, adjustable hanger 101 may be comprised of plastic. In another embodiment, coupler 103 may be comprised of metal, while arms 104 and hook 102 may be comprised of plastic. Other raw materials may be used to construct adjustable hanger 101 without departing from the nature of adjustable hanger 101.

Adjustable hanger 101 may be adjustable. As depicted in FIG. 1, arms 104 may be releasably attached to either side of coupler 103 and thereafter adjusted, such that the distal end of either arm 104 may be manually extended from a central point located on coupler 103 near where hook 102 is attached. Arms 104 may also be manually retracted, such that the distal end of either arm 104 may come to rest at a closer point in relation to a central point on coupler 103. This adjustability may allow for both larger and smaller garments to be hung on the same adjustable hanger 101.

One feature that may make adjustability easier for an end user may be the inclusion of openings 109. As depicted in FIG. 1, openings 109, may be in the in the shape of a circle with a diameter such as to easily allow for a finger to be inserted in said circle. Said finger may then either push or pull on arm 104 to retract or extend it in relation to coupler 103. Another feature of openings 109 may include their use as a measuring device. One may use openings 109 as a visual to ensure that each arm is extended to an equal distance from coupler 103. For example, one may extend each arm 104 such that there are an equal number of openings 109 on each arm 103 on the exterior of coupler 103.

Openings 109 may also serve to cut down on the cost of making and shipping adjustable hanger 101, as fewer raw materials may be used to construct adjustable hanger 101. Furthermore, opening 109 need not be in the shape of a circle that would be amenable to a finger. The location on arm 104 resting within the confines of coupler 103, for example, may also include several openings 109 that are more ovular in nature. These various shapes, however, are irrelevant, as opening 109 may be in the form of any shape. The number of openings 109 is also irrelevant, as arm 104 may be comprised of one large opening 109, extending from the proximal to the distal end of arm 104. In another embodiment, arm 104 may be comprised of several hundred small openings 109 in the form of a plastic mesh, for example. Although it may not be practical to use a finger to adjust such an adjustable hanger 101 through such a small opening 109, this design may be desirable as a means of reducing costs. In another embodiment, adjustable hanger 101 may include arms 104 sans openings 109.

Arm 104 may also be comprised of shoulder support 105. Shoulder support 105 may generally be located on the upper portion of arm 104, extending the length from arm's 104 distal end to a portion near its center. Shoulder support 105, however, may also extend the length of arm 104. Shoulder support 105 may be the widest part of arm 104. Such width may allow for garments to properly rest upon adjustable hanger 101 such that they do not become creased or bumpy.

Shoulder support 105 may also be curved. Such curvature may match the natural curvature of a human shoulder. The curvature may also be similar to the manufactured curvature of a mannequin. Similar to a mannequin, a garment such as a T-shirt may be placed on the natural curvature of shoulder support 105 such that creases, bumps, etcetera may be altogether avoided.

Arm 104 may also be comprised of rail 106 and rail groove 107. Rail 106 may be located on the lower portion of arm 104, opposite the portion where shoulder support 105 is situated, i.e., the upper portion of arm 104. Rail groove 107 may rest on the underside and center of rail 106, as depicted by the embodiment in FIG. 1. Rail 106 and rail groove 107 may work in conjunction with holders 108 located on coupler, as one means by which arm 104 may be securely attached to coupler 103. A protrusion may be situated on the upper portion of holders 108 that may serve to guide arm 104 when releasably connected to coupler 103.

As shown in FIG. 1, holders 108 may be an extension of coupler 103. Coupler 103 may further be comprised of several holders 108. Four are depicted in FIG. 1, with two on either end of coupler 103. More or less holders 108 may be utilized without departing from the scope of adjustable hanger 101. In another embodiment, for example, coupler 103 may be comprised of two holders 108, with one on each distal end. In yet another embodiment, arm 104 may be secured to coupler 103 such that holders 108 are unnecessary.

Figure 2:
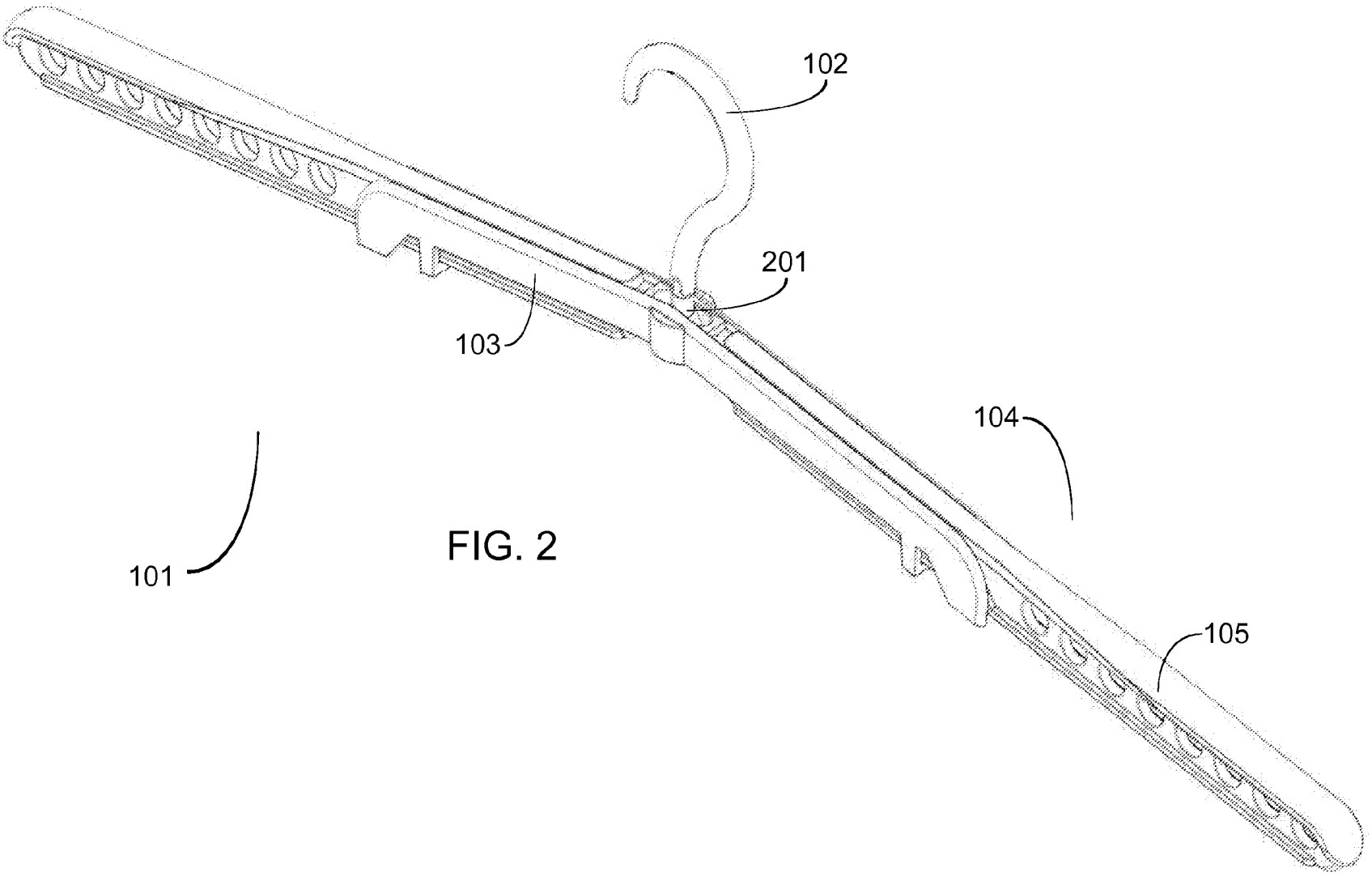
FIG. 2 is a three dimensional upper view of an adjustable hanger.

FIG. 2 is a three dimensional upper view of adjustable hanger 101. FIG. 2 further depicts hook base 201. Hook base 201 may be located at the base of hook 102 and configured as a male connector that may be releasably connected to coupler 103. The central portion of coupler 103 may further be configured as a female connector such as to receive the male connector of hook base 201. As depicted in FIG. 2, hook 102 may be inserted through the bottom of coupler 103 such that the male connector of hook base 201 comes to rest and can go no further past the point of the female connector located within coupler 103. The design of said male/female connection may further allow for hook 102 to swivel 360 degrees in relation to coupler 103.

It may also be noted in FIG. 2 how shoulder support 105 on arm 104 gradually widens from near the center of arm 104 to the distal end of arm 104 while at the same time tapering off such that shoulder support 105 is comprised of a curvature that may be amenable to the inherent curvature of various garments, including but not limited to the shoulder portions of jerseys, T-shirts, coats, etc.

Figure 3:
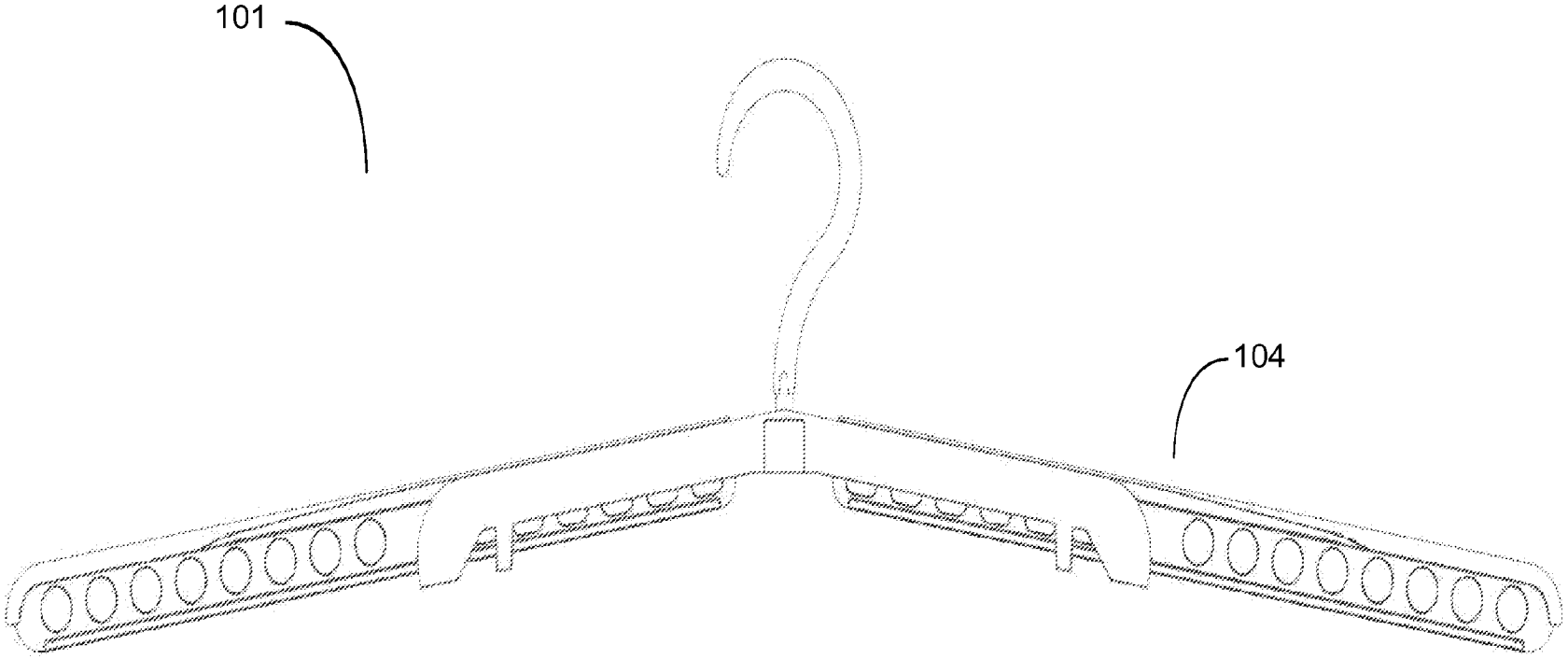
FIG. 3 a front elevation view of an adjustable hanger.

FIG. 3 a front elevation view of adjustable hanger 101. FIG. 3 depicts arms 104 in a position such that they are fully retracted. Such a position may allow for a garment of a smaller size to be hung upon hanger 101. Because adjustable hanger 101 is adjustable, however, arm 104 may be extended to allow for a larger garment to be hung. For example, were both arms 104 to be extended to their maximum allowable distances, this may effectively allow for adjustable hanger's 101 wingspan depicted in FIG. 3 to be increased in size by around fifty percent.

Figure 4:
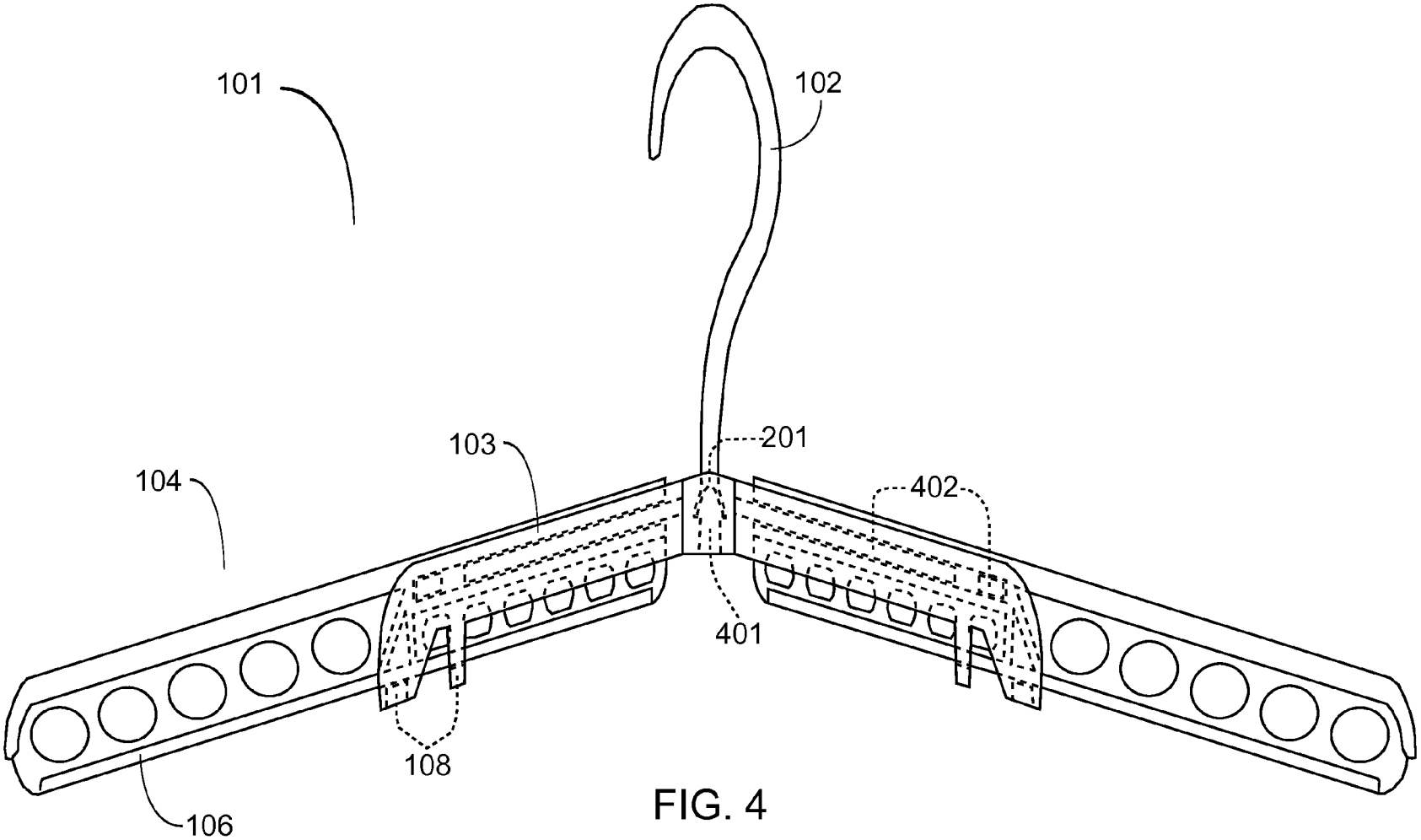
FIG. 4 is a front elevation view depicting interior details of an adjustable hanger, including an alternative embodiment of the male/female connection between a hook and a coupler.

FIG. 4 is a front elevation view depicting interior details of an alternative embodiment of adjustable hanger 101, namely how hook base 201 may be configured as a female connector rather than a male connector and connected to hook receiver 401. In FIG. 4 hook base 201 may be releasably and securely attached to hook receiver 401 located on coupler 103 by an end user. In this embodiment, however, the end user may attach hook 102 to the top of coupler 103, rather than going through the bottom as described above. In another embodiment, hook base 201 may merely be connected to hook receiver 401 and not releasable. Hook receiver 401 may be located in a central point on coupler 103 near where hook 102 may be attached via the male connector of hook receiver 401 and the female connector of hook base 201. This central location may also add an element of balance to adjustable hanger 101. This reversed male/female connection between hook base 201 and coupler 103 may also allow for hook 102 to swivel 360 degrees in relation to coupler 103. With either type of male/female connection, hook 102 may have an inherent level of swivel adjustability. In another embodiment, however, hook 102 may be solidly connected to coupler 103, such that hook 102 is affixed to a single position in relation to coupler 103.

FIG. 4 further depicts arm receiver 402. Arm 104 may be releasably attached to coupler 103 via arm receiver 402, which may be configured in the form of a male connector. Arm 104 may be configured as a female connector, such that it may be securely and releasably attached with coupler 103.

FIG. 4 also depicts how arm receiver 402 and holders 108 may work in tandem to help keep arm 104 secured to coupler 103. Arm 104 may be attached to coupler 103 via a male/female connection, near the upper portions of both arm 104 and coupler 103. Simultaneously, rail 106, located on the lower portion of arm 104, may be situated above holders 108 on the lower portion of coupler 103. This upper support with the male/female connection combined with the lower support of holder 108 may allow for a sufficient measure of support such that arm 104 is securely attached to coupler 103.

Figure 5:
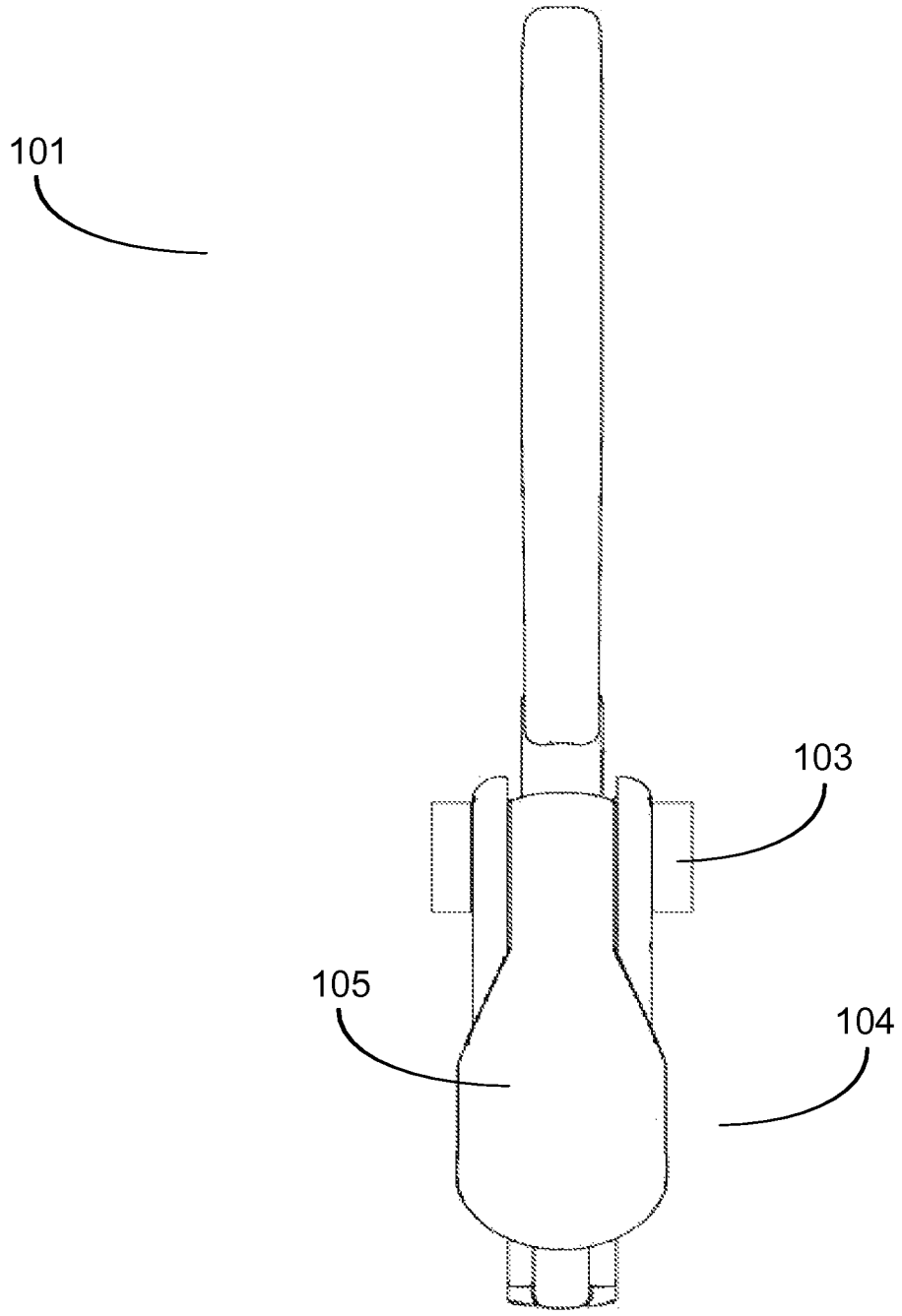
FIG. 5 is a side elevation view of an adjustable hanger.

FIG. 5 is a side elevation view of adjustable hanger 101. From this perspective, it may generally be noted how shoulder support 105 may be generally curved and of a substantially wider nature than a conventional wire or plastic hanger. As discussed above, this may allow for various garments, including garments worn about the torso, to be hung as if they were naturally being hung about the shoulders of a human body. It may also be noted that arm 104 may vary in width from the distal end of shoulder support 105 to the proximal end of arm 104. In another embodiment however, the width of shoulder support 105 may be continuous.

FIG. 5 further depicts how coupler 103 may be comprised with a channel of such a width to allow for the proximal portion of arm 104 to be attached to coupler 103. As shown in FIG. 5, the channel of coupler 103 may be of such a width as to match the width of the proximal end of arm 104. As such, another level of stability may be found between coupler 103 and arm 104.

Figures 6A, 6B:
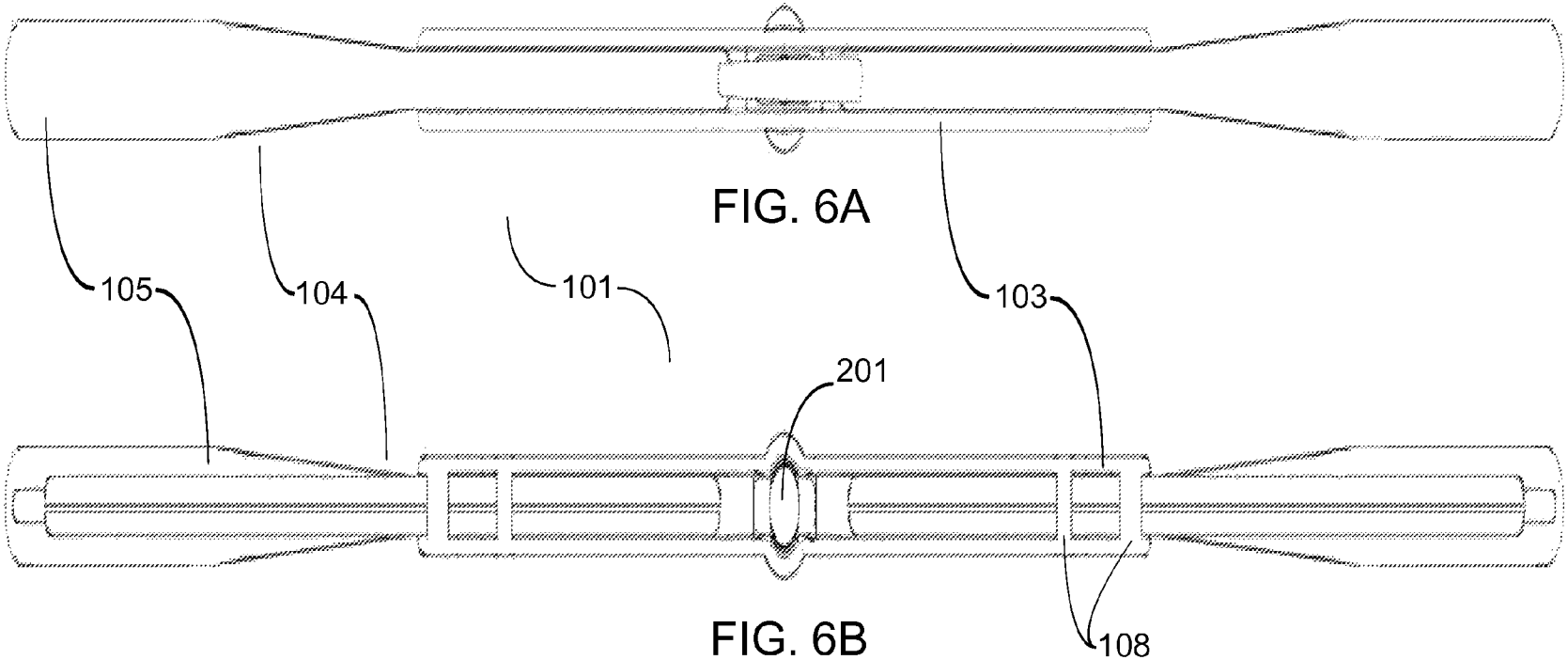
FIG. 6A is a plan view of an adjustable hanger.
FIG. 6B is a bottom view of an adjustable hanger.

FIG. 6A is a plan view of adjustable hanger 101. FIG. 6B is a bottom view of adjustable hanger 101. FIGS. 6A and 6B generally depict how the distal portions of both shoulder supports 105 of arm 104 may be of a wider nature than the proximal portions of arm 104 and also of coupler 103. Both FIGS. 6A and 6B also give another view of the channel that coupler 103 may be comprised of to allow for arms 104 to be securely connected to coupler 103.

FIG. 6B further shows an alternative view of holders 108. Four holders 108 are clearly depicted, two on each end of coupler 103. However, this is not to narrow the scope of adjustable hanger 101. As previously discussed, in another embodiment, only two holders 108 may be necessary with one located on each side of coupler 103. In another embodiment, no holders 108 may be necessary where arm 104 is securely attached to coupler 103, such as through a male/female configuration between arm 104 and coupler 103. Other means may also be used.

FIG. 6B also shows adjustable hanger with a hook base 201 configured as a male connector, releasably attached to a female connector located in the center of coupler 103. As discussed above, this configuration may allow for an end user to releasably attach hook base 201 to coupler 103 by inserting it from below coupler 103 and pushing it into the female connector on coupler 103.

Figure 7:
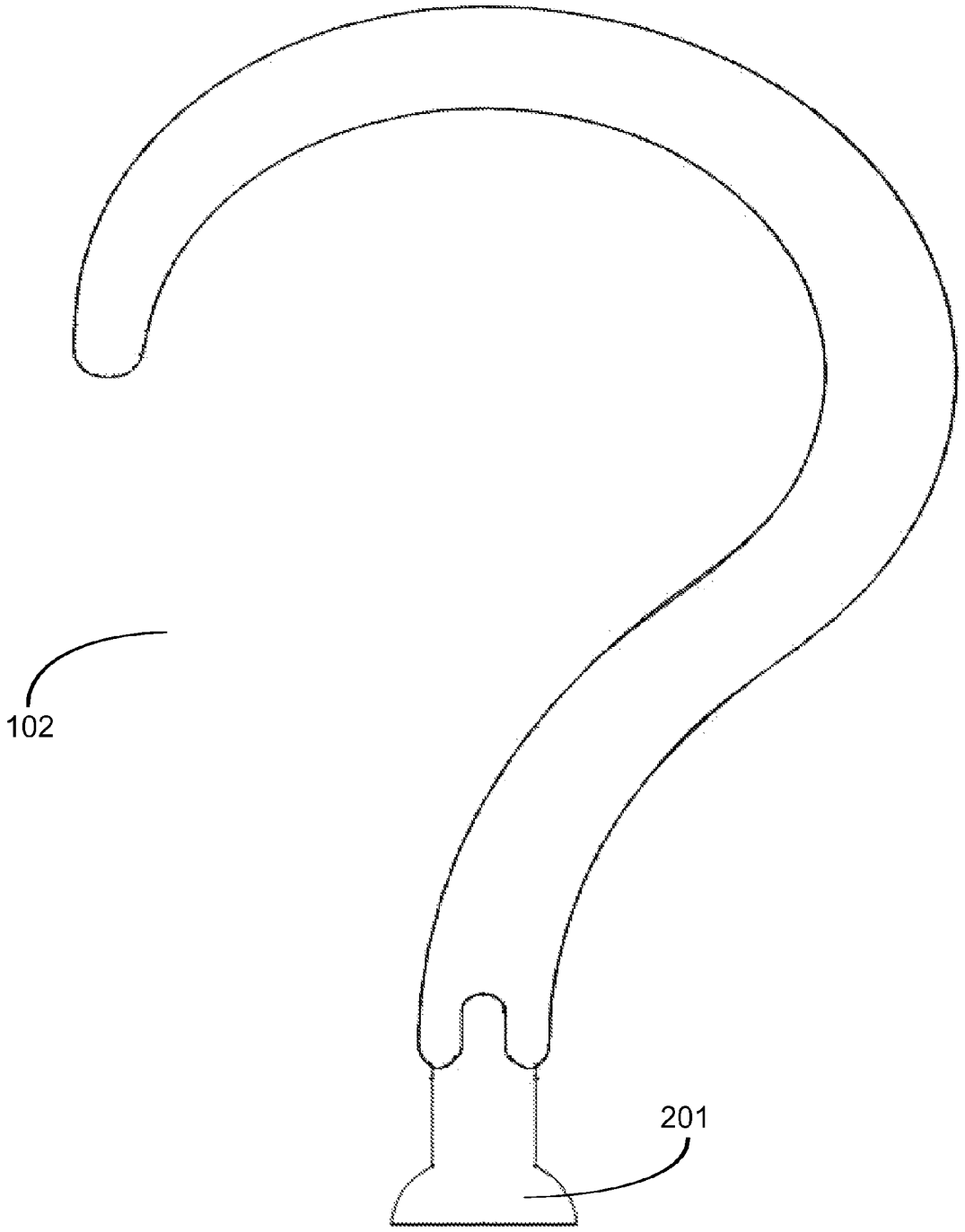
FIG. 7 is a front elevation view of a hook.

FIG. 7 is a front elevation view of hook 102. Hook 102 may be further comprised with hook base 201, which is clearly depicted in FIG. 7. As noted above, hook base may be configured as a male or female connector. As a female connector, hook 102 may be snapped into place on a male connector located on coupler 103, such as hook receiver 401 as shown in FIG. 4. As a male connector, hook 102 may be inserted through the bottom of coupler 103, such that hook base 201 comes to rest within a female connector located in a central portion on coupler 103.

Figure 8:
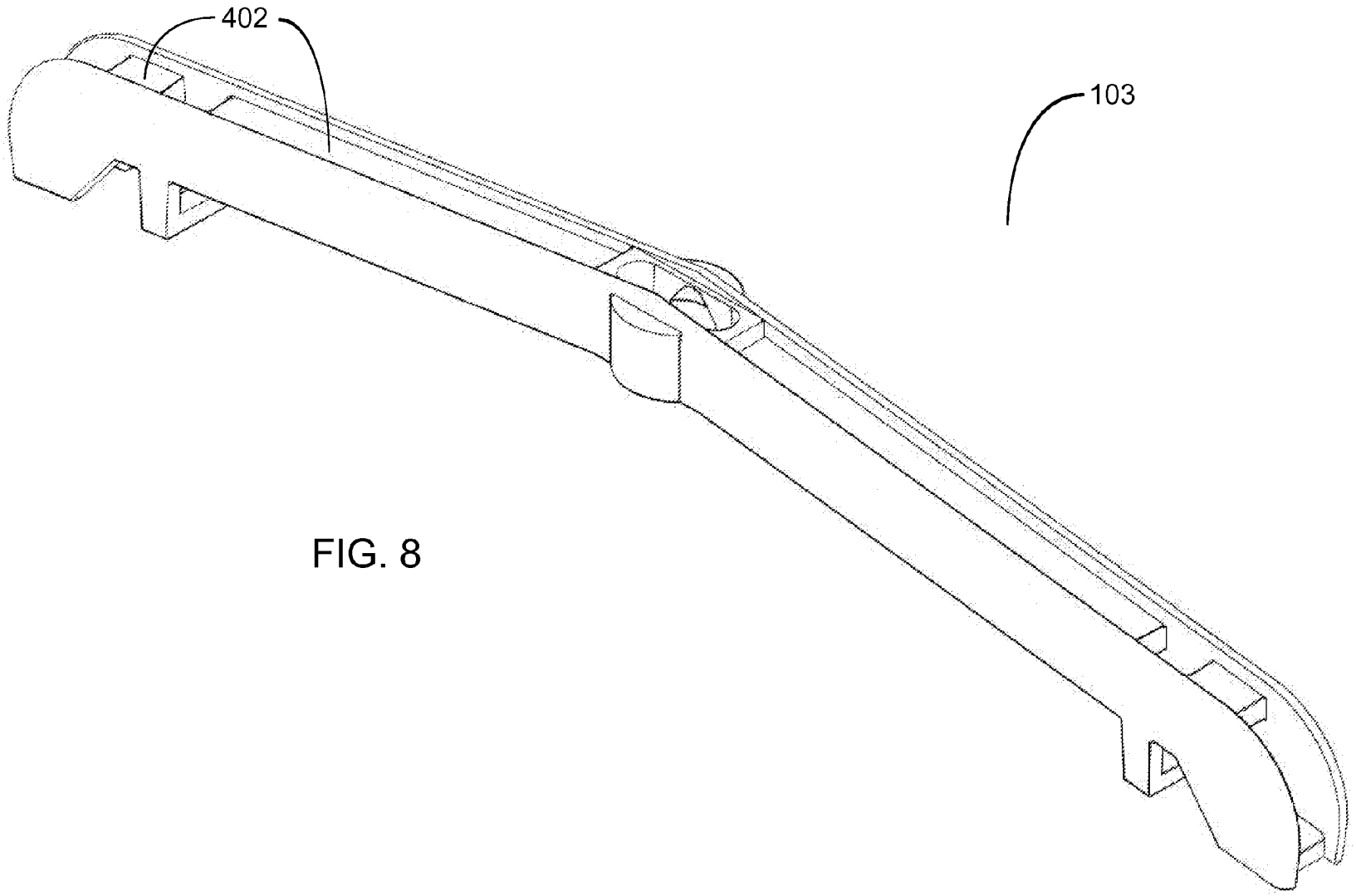
FIG. 8 is a three dimensional upper view of a coupler.

FIG. 8 is a three dimensional upper view of coupler 103. As shown without the other components of which adjustable hanger 101 may be comprised, additional features of coupler 103 are visible in this FIG., namely arm receivers 402. Arm receivers 402 may be solidly connected to coupler 103 during the manufacturing process and located within coupler's 103 channel.

Other embodiments with different configurations of arm receiver 402 are possible, however, without departing from the scope of adjustable hanger 101. For example, rather than having arm receiver 402 broken into two separate pieces as shown on the left side of coupler 103 in FIG. 8, arm receiver 402 may be in a single solid configuration. Arm receiver 402, may also be longer or shorter. These variations are well within the scope of adjustable hanger 101.

Figures 9A, 9B:
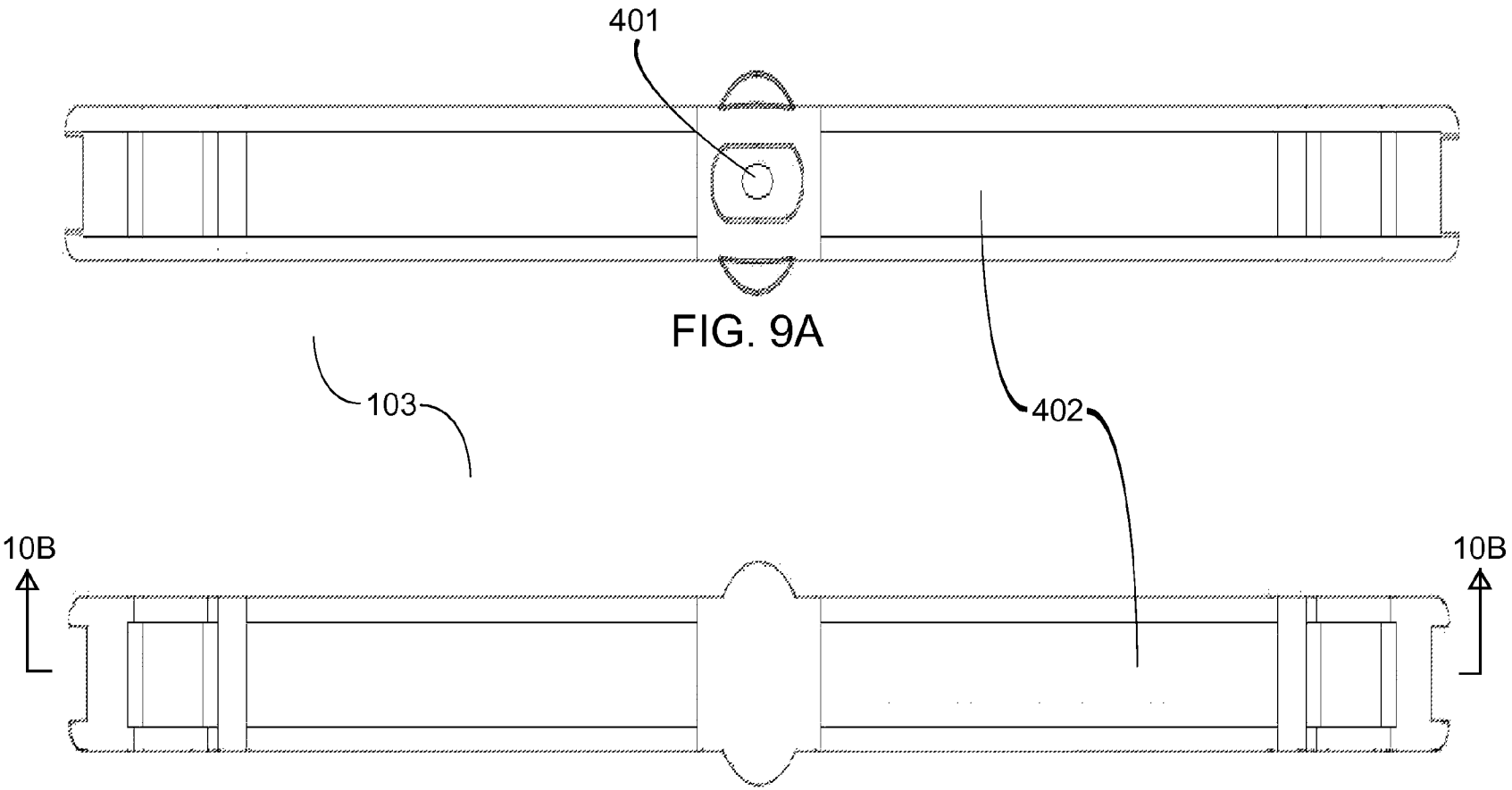
FIG. 9A is a plan view of a coupler.
FIG. 9B is a bottom view of a coupler.

FIG. 9A is a plan view of coupler 103. FIG. 9B is a bottom view of coupler 103 with a FIG. 10B cross section line. It may be noted that in both FIGS. 9A and 9B, coupler 103 may be comprised of arm receivers 402 which may be solidly connected within the channel of coupler 103. It may also be noted that coupler 103 may be further comprised of hook receiver 401, a male connector, which may be solidly connected to coupler 103 as depicted in FIG. 9A.

Figure 10A:
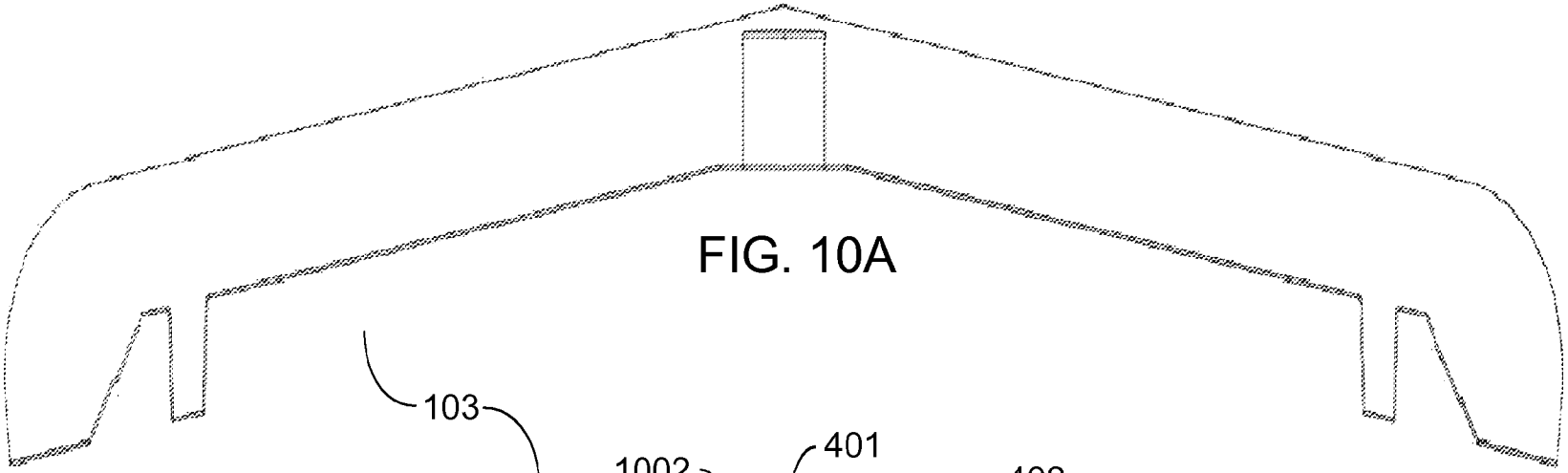
FIG. 10A is a front elevation view of a coupler.
Figure 10B:
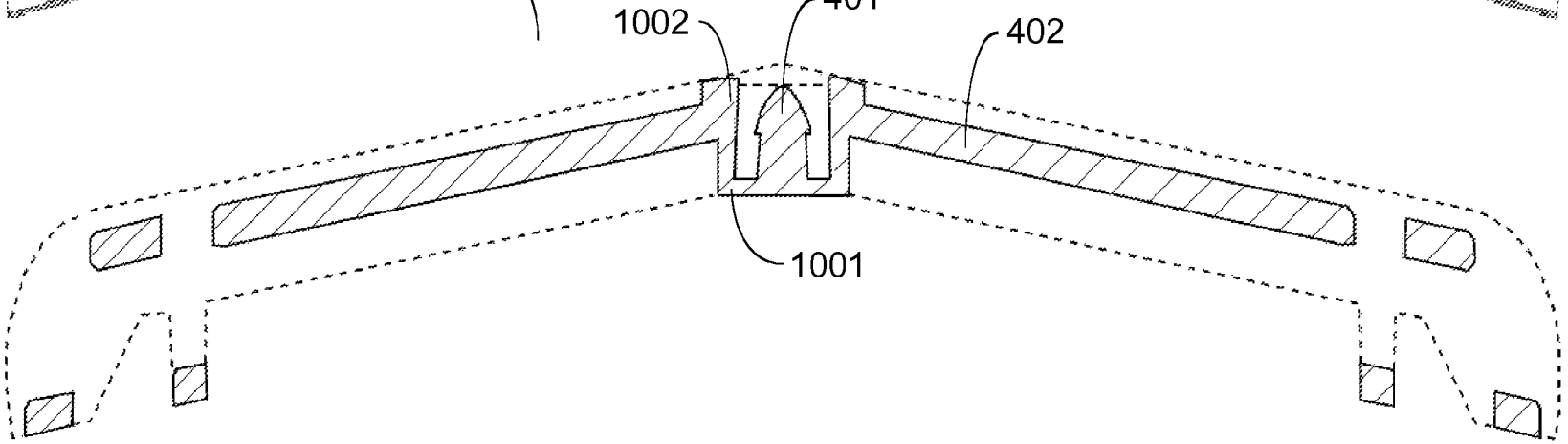
FIG. 10B is a front elevation cross section view of the coupler in FIG. 9B.

FIG. 10A is a front elevation view of coupler 103. FIG. 10B is a front elevation cross section view of coupler 103. The cross section depicted is demarcated by the 10B cross section line in FIG. 9B. FIG. 10B shows how the components within the channel of coupler 103 may be connected to one another. For example, hook receiver 401 may be solidly connected to interior floor 1001 and interior wall 1002, which may then be solidly connected to the proximal portions of arm receivers 402. This depiction is not to limit the scope, however, of adjustable hanger 101. Although some of the interior components of coupler 103 may be solidly connected to one another, in another embodiment, these various components may also be independent of one another and secured solely by a solid connection to the channel walls of coupler 103. This may be demonstrated in FIG. 10B by the distal portions of both arm receivers 402. Said distal portions are independently and solidly connected to the channel of coupler 103. In another embodiment, arm receiver 402 may be one solid configuration and only attached to the channel walls of coupler 103.

Figure 11:
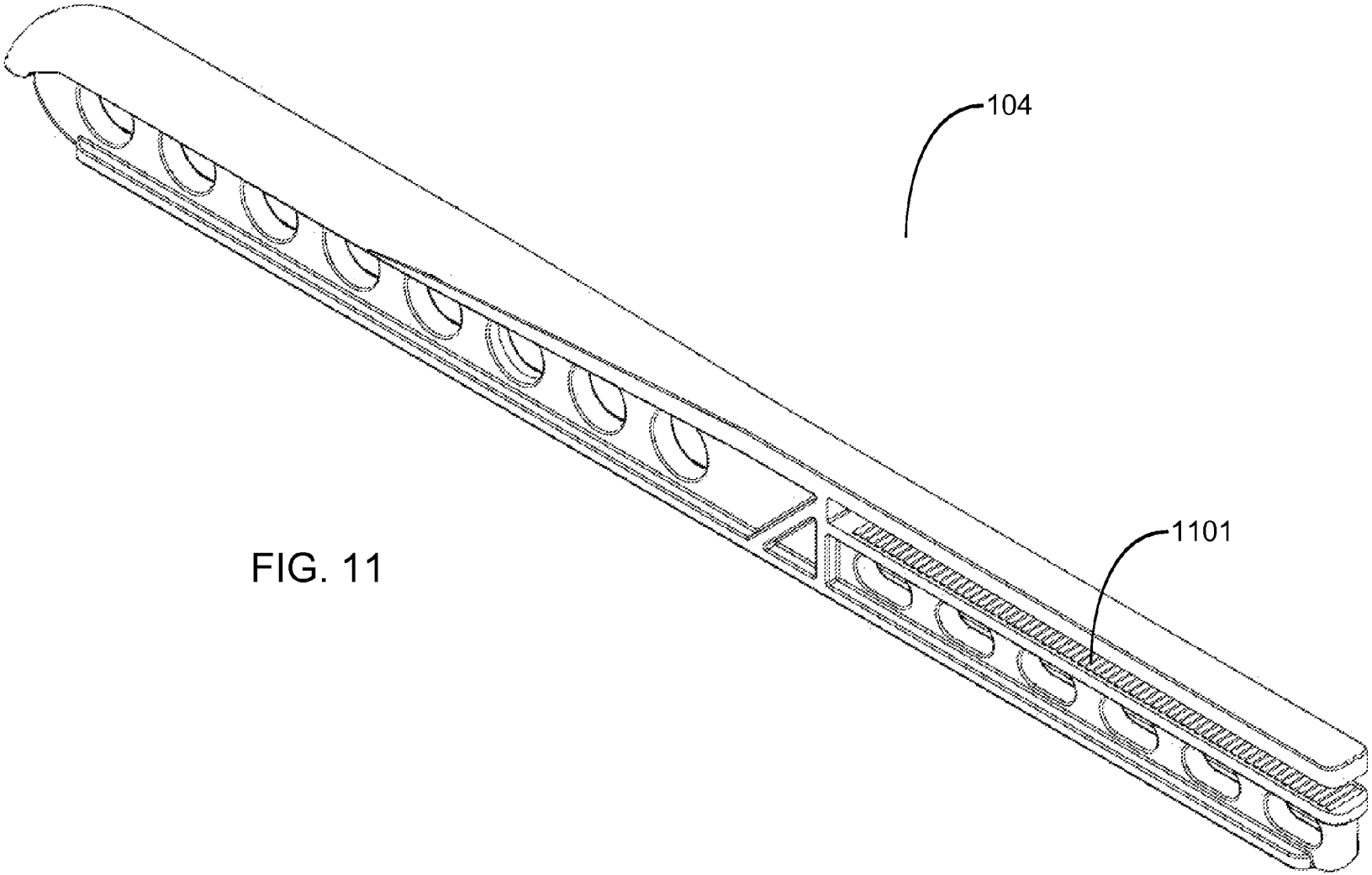
FIG. 11 is a three dimensional upper view of an arm.

FIG. 11 is a three dimensional upper view of arm 104. An additional feature which may be noted on the female connector of arm 104 includes female teeth 1101. Female teeth 1101 may serve a similar function to female threads in a female nut. Thus, the female connector of arm 104 may be thrust upon arm receiver 402, said arm receiver 402 being further comprised of male teeth, for example. Once fully connected, said interlocking teeth may naturally clench one another and secure arm 104 to coupler 103.

Figure 12:
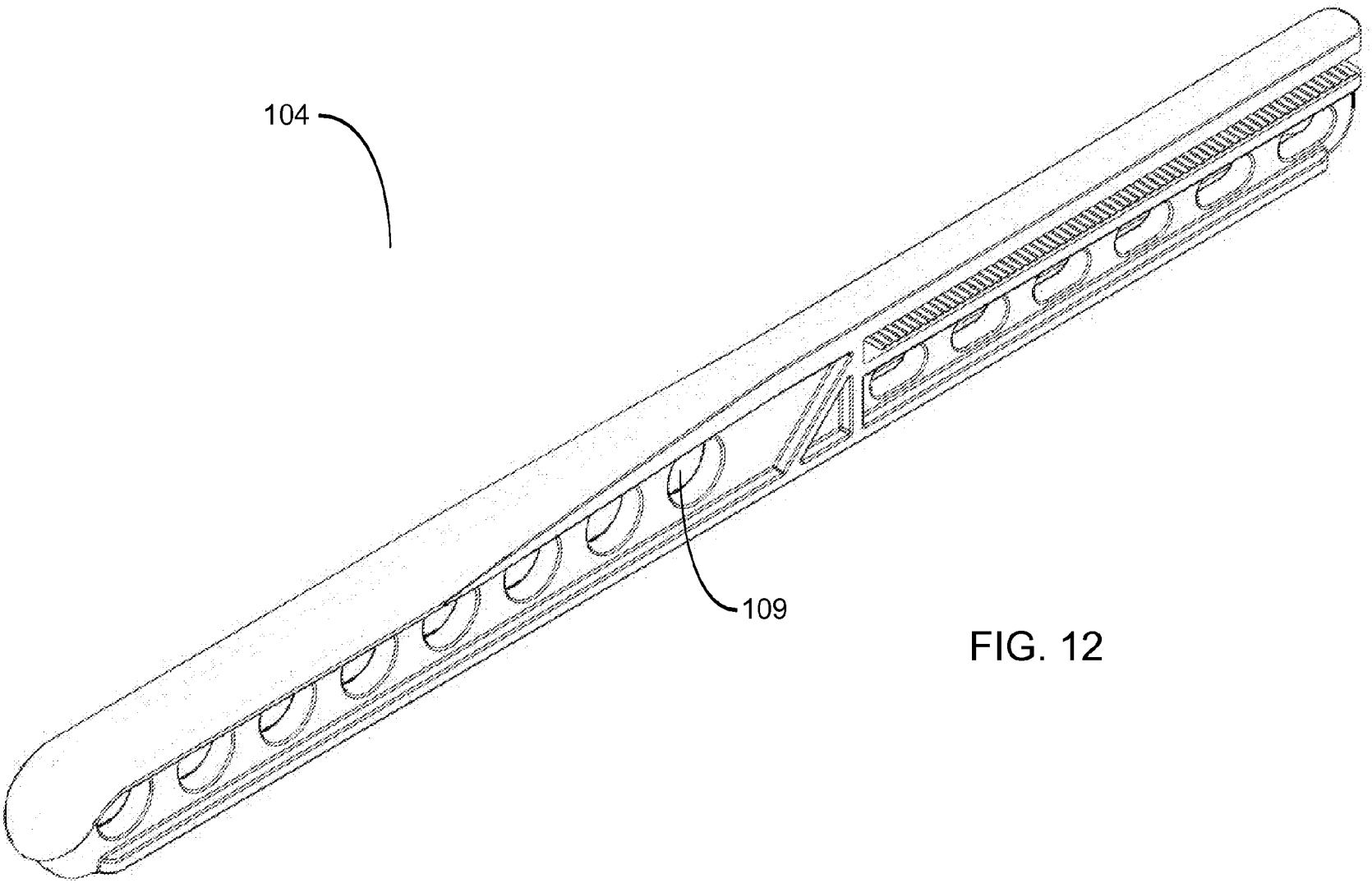
FIG. 12 is a three dimensional alternative upper view of an arm.
Figure 13:
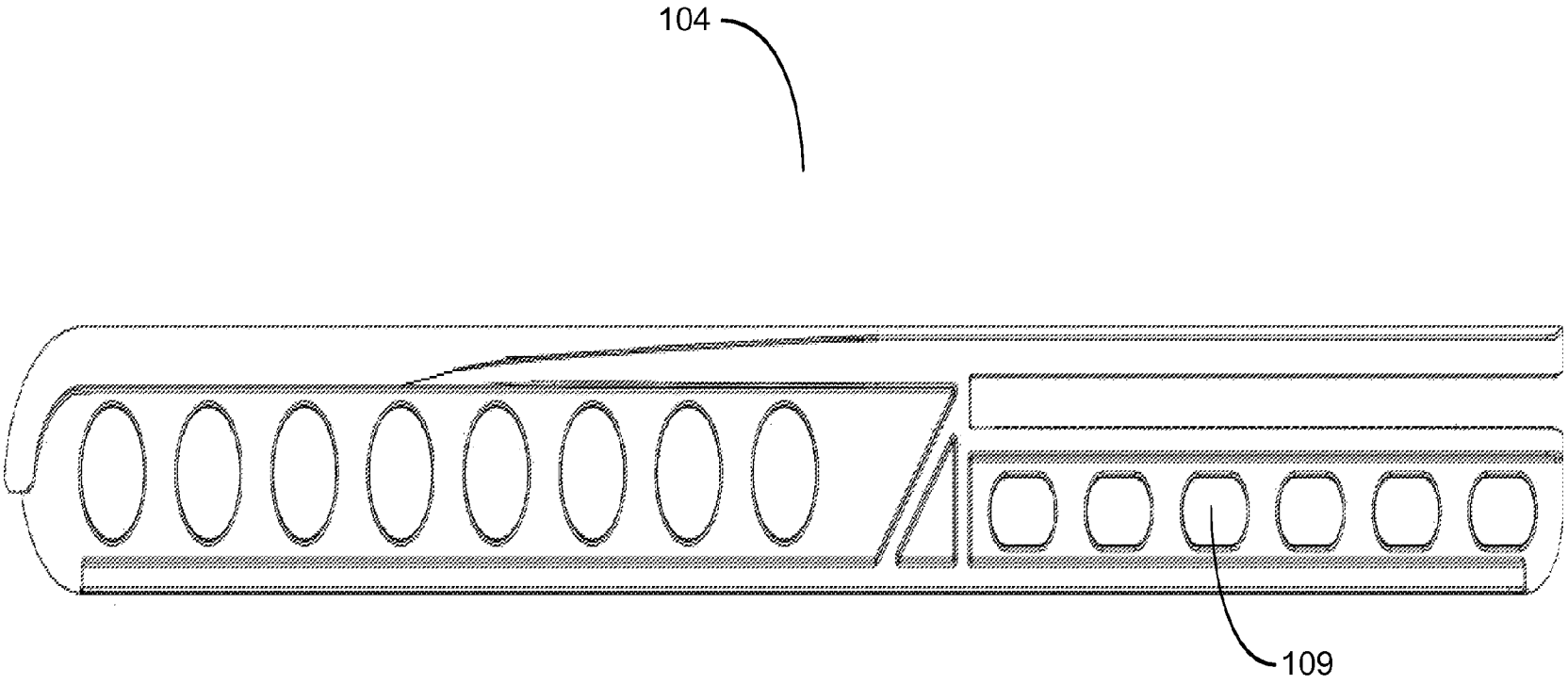
FIG. 13 is a front elevation view of an arm.

FIG. 12 is a three dimensional alternative upper view of arm 104. FIG. 13 is a front elevation view of arm 104. These FIGS. should not be taken as limiting adjustable hanger 101 to the forms depicted. Arm 104 may take on other variations with different features. Such other variations may include arm 104 sans openings 109. In another embodiment, arm 104 may have a female connector with no teeth 1101. In yet another embodiment of adjustable hanger 101, coupler 103 may be comprised of a female connector while arm 104 may be comprised of a male connector. This reversal of roles is still within the scope of adjustable hanger 101.

Figure 14A:
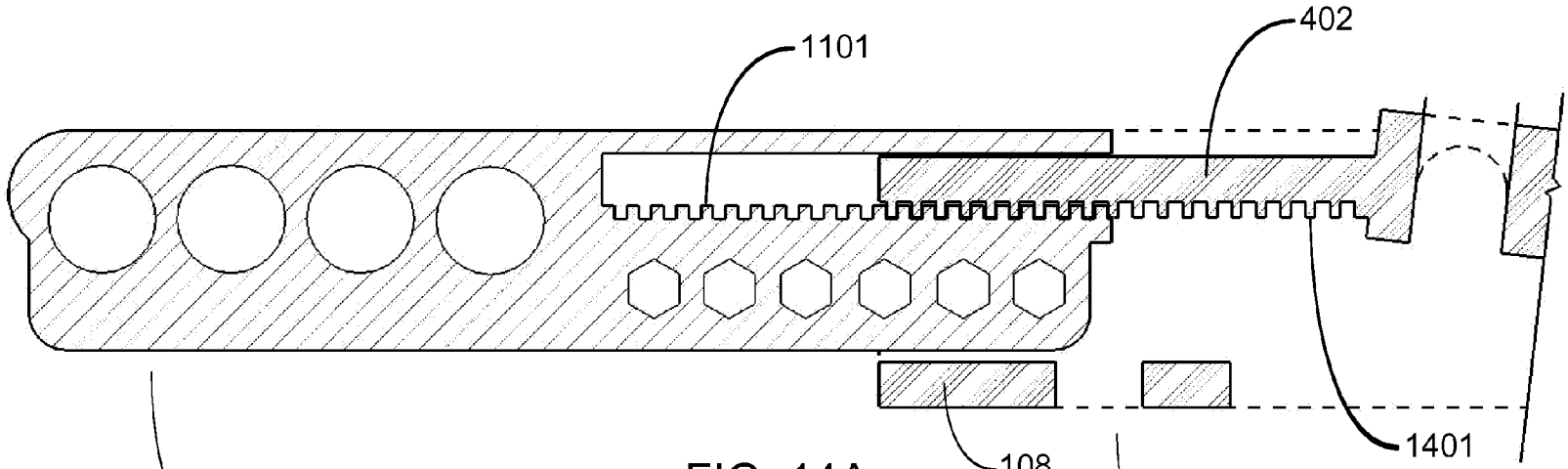
FIG. 14A is a front elevation cross section view of an alternative embodiment depicting an arm, coupler, and teeth.

FIG. 14A is a front elevation cross section view of an alternative embodiment depicting arm 104, coupler 103, female teeth 1101, and male teeth 1402. It may be noted as there is no other FIG. demarcating a cross section line, it may be assumed that from a plan view of this embodiment, the cross section line would horizontally bisect the embodiment. As depicted, arm 104 may be extended away from coupler 103, thus allowing for adjustable hanger 101 to be adjustable. Arm 104 may also be secured by male teeth 1401 located on arm receiver 402 interlocking with female teeth 1101 located on arm 104. Said male teeth 1401 and female teeth 1101 may be configured with such raw materials as to allow for arm 104 to easily adjust and to easily interact with one another, but to also provide the necessary support such that arm 104 does not simply fall off of coupler 103.

FIG. 14A also depicts how one holder 108 may be employed when arm 104 is extended to such a length that another holder 108 may not be employed. As discussed above however, the male/female connection between arm 104 and coupler 103 via said interlocking male 1401 and female teeth 1101 may facilitate a design that requires no holders 108 to be employed in order to properly function.

Figure 14B:
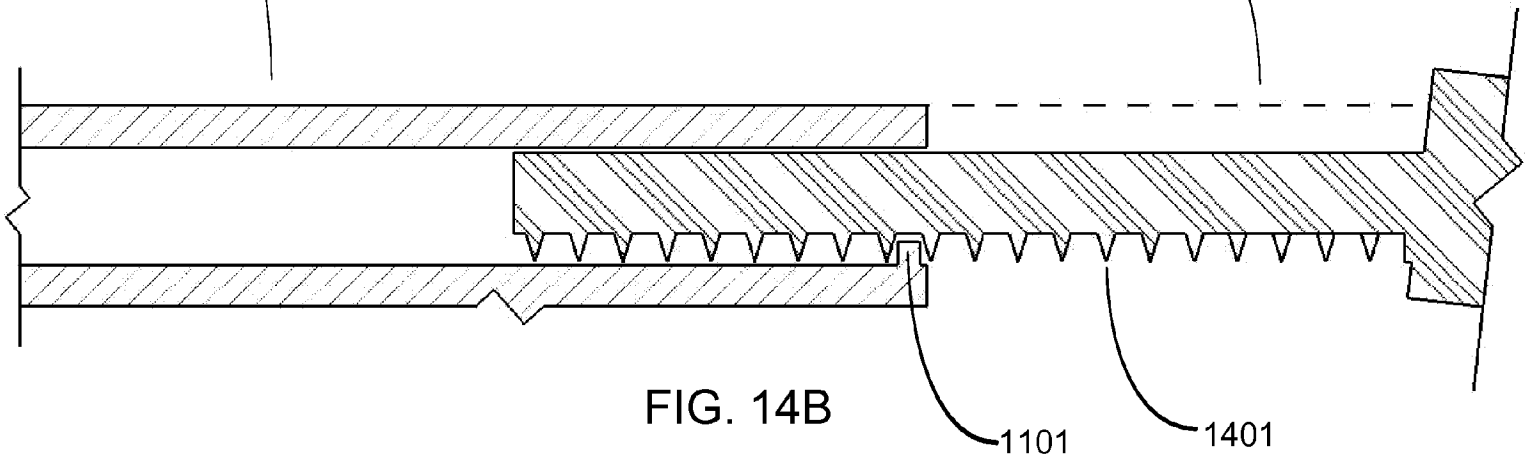
FIG. 14B is a front elevation cross section close up view of an alternative embodiment depicting an arm, coupler, and teeth.

FIG. 14B is a front elevation cross section close up view of an alternative embodiment depicting arm 104, coupler 103, female teeth 1101, and male teeth 1401. It may be also noted here as there is no other FIG. demarcating a cross section line, it may be assumed that from a plan view of this embodiment, the cross section line would horizontally bisect the embodiment. In this embodiment, only one female tooth 1101 is depicted. Nevertheless, said one female tooth 1101 may still provide a level of resistance sufficient to hold arm 104 in place on coupler 103. In order to remove arm 104 from coupler 103, it may still be necessary that each male tooth 1401 would have to surpass the resistance of said one female tooth 1101. Furthermore, alternative male teeth 1401 on coupler 103 teach that several variations on teeth may still be used without departing from the scope of the adjustable hanger 101.

An adjustable hanger has been described. The foregoing description of the various exemplary embodiments of the adjustable hanger has been presented for the purposes of illustration and disclosure. It is not intended to be exhaustive or to limit the adjustable hanger to the precise form disclosed. Many modifications and variations are possible in light of the above teaching without departing from the spirit of the adjustable hanger.

What is claimed is:

1. An adjustable hanger comprising:

a coupler having a first male coupler connector and a second male coupler connector;

a hook member;

a first arm comprising a first shoulder portion and a first female arm connector;

a second arm comprising a second shoulder portion and a second female arm connector;

one or more first arm holders configured such that said first arm is situated above said one or more first arm holders when said first arm is releasably attached to said coupler; and one or more second arm holders configured such that said second arm is situated above said one or more second arm holders when said second arm is releasably attached to said coupler;

wherein:

said coupler is configured to receive said hook member, said first arm, and said second arm, said hook member, said first arm, and said second arm are releasably connected to said coupler;

said first arm comprises a first rail on the lower portion of said first arm extending the length of said first arm, said first rail situated above said one or more first arm holders when said first arm is releasably connected to said coupler, and said second arm comprises a second rail on the lower portion of said second arm extending the length of said second arm, said second rail situated above said one or more second arm holders when said second arm is releasably connected to said coupler;

said first arm comprises a first center portion extending the length of said first arm between said first rail and said first shoulder portion, said first center portion comprising one or more first openings extending the length of said first center portion, and said second arm further comprises a second center portion extending the length of said second arm between said second rail and said second shoulder portion, said second center portion comprising one or more second openings extending the length of said second center portion;

said first rail comprises a first groove situated underneath said first rail and extending the length of said first rail, and said second rail comprises a second groove situated underneath said second rail and extending the length of said second rail; and said one or more first arm holders comprises one or more first protrusions situated near the upper center portion of said one or more first arm holders, configured to guide and receive said first groove when said first arm is releasably connected to said coupler, and wherein said one or more second arm holders comprises one or more second protrusions situated near the upper center portion of said one or more second arm holders, configured to guide and receive said second groove when said second arm is releasably connected to said coupler.

2. An adjustable hanger comprising:

a coupler comprising a first male coupler connector and a second male coupler connector, wherein said first male coupler connector comprises a first plurality of male teeth, and said second male coupler connector comprises a second plurality of male teeth;

a hook member;

a first arm comprising a first shoulder portion and a first female arm connector, wherein said first female arm connector of said first arm comprises at least one first female tooth; and a second arm comprising a second shoulder portion and a second female arm connector wherein said second female arm connector of said second arm comprises at least one second female tooth;

wherein:

said coupler is configured to receive said hook member, said first arm, and said second arm:

said hook member, said first arm, and said second arm are releasably connected to said coupler;

said hook member is releasably connected to said coupler, said hook member comprising a male hook base connector, and said coupler comprising a female hook base connector;

said hook member is releasably connected to said coupler such that said hook member is capable of rotating about an axis running perpendicularly from a planar surface through the center of said male hook base connector and said female hook base connector of said adjustable hanger in an upright position;

said coupler comprises:

one or more first arm holders configured such that said first arm is situated above said one or more first arm holders when said first arm is releasably attached to said coupler; and one or more second arm holders configured such that said second arm is situated above said one or more second arm holders when said second arm is releasably attached to said coupler;

said first arm comprises a first rail on the lower portion of said first arm extending the length of said first arm, said first rail situated above said one or more first arm holders when said first arm is releasably connected to said coupler, and said second arm comprises a second rail on the lower portion of said second arm extending the length of said second arm, said second rail situated above said one or more second arm holders when said second arm is releasably connected to said coupler; and said first arm comprises a first center portion extending the length of said first arm between said first rail and said first shoulder portion, said first center portion comprising one or more first openings extending the length of said first center portion, and said second arm further comprises a second center portion extending the length of said second arm between said second rail and said second shoulder portion, said second center portion comprising one or more second openings extending the length of said second center portion.

* * * * *